US005158753A

United States Patent [19]

Take et al.

[11] Patent Number: 5,158,753

[45] Date of Patent: Oct. 27, 1992

[54] INTERNAL COMBUSTION ENGINE EXHAUST GAS PURIFYING DEVICE AND PROCESS

[75] Inventors: Shigeo Take, Kanagawa; Masaji Kurosawa, Chiba, both of Japan

[73] Assignee: Nichias Corporation, Tokyo, Japan

[21] Appl. No.: 626,002

[22] Filed: Dec. 12, 1990

[30] Foreign Application Priority Data

Dec. 12, 1989 [JP] Japan ..... 1-142811[U]

[51] Int. Cl.[5] ..... F01N 3/10

[52] U.S. Cl. ..... 422/173; 422/175; 422/177; 55/269; 55/DIG. 30

[58] Field of Search ..... 422/173, 175, 177; 55/DIG. 30, 269

[56] References Cited

U.S. PATENT DOCUMENTS

| | | | |
|---|---|---|---|
| 3,067,002 | 12/1962 | Reid | 422/177 |
| 3,150,922 | 9/1964 | Ashley | 422/177 |
| 3,295,919 | 1/1967 | Henderson et al. | 55/DIG. 30 |
| 4,047,895 | 9/1977 | Urban | 422/177 |
| 4,436,701 | 3/1984 | Richter et al. | 422/173 |
| 4,912,928 | 4/1990 | Kaneko et al. | 422/173 |
| 4,985,210 | 1/1991 | Minami | 422/172 |

*Primary Examiner*—Lynn M. Kummert
*Assistant Examiner*—Krisanne M. Thornton
*Attorney, Agent, or Firm*—Cushman, Darby & Cushman

[57] ABSTRACT

An engine exhaust gas purifying device, and process, wherein the device provides a catalyst device for treating the exhaust gas, an adsorbing device for adsorbing materials from the exhaust gas and a heat exchanger. The device is configured so that high temperature exhaust gas from the engine passes through a high temperature side of the heat exchanger prior to passing through the adsorbing device. After passing through the adsorbing device, the gas passes through the low temperature side of the heat exchanger and then passes to the catalyst device. In an alternate embodiment of the present invention, the catalyst can be disposed in the low temperature side of the heat exchanger.

9 Claims, 1 Drawing Sheet

INTERNAL COMBUSTION ENGINE EXHAUST GAS PURIFYING DEVICE AND PROCESS

BACKGROUND

1. Field of the Invention

This invention relates to an exhaust gas purifying device for an internal combustion engine.

2. Description of the Related Art

Almost all internal combustion engines, depending on the engine type and fuels employed, discharge a variety of harmful gases in addition to carbon dioxide gas and steam. A relatively large quantity of harmful gas is discharged at the start of the engine—that is, when the engine cylinder temperature is low. Thus, it is necessary to provide an exhaust gas purifying means for an internal combustion engine, particularly for application when the engine cylinder temperature is low.

For instance, in the case of a diesel engine using methanol as its fuel, the discharge gas contains, among other organic substances, formaldehyde produced by incomplete combustion of the methanol fuel. Formaldehyde is not only malodorous but also injurious to the human body, and therefore it should not be released into the air. To prevent this release to the air, a method may be employed in which the formaldehyde and other organic substances are decomposed through oxidation by using a catalyst of noble metal such as platinum, palladium, cobalt or nickel before the substances are released into the air. However, this method is not substantially effective in the case where the exhaust gas temperature is lower than 100°, such as occurs during the warming up of the engine. This is because it requires a high temperature of about 200° C. or higher to make the noble metal catalyst active.

Furthermore, organic substances such as formaldehyde and methanol not burned are discharged in relatively high amounts until the engine is warmed up. Accordingly, even if a catalyst is used, the exhaust gas is undesirably high in contaminants during warm up of the engine.

In order to overcome the above-described difficulties, Japanese Utility Patent Applications (OPI) Nos. 5820/1987 and 10223/1987 (the term "OPI" as used herein meaning an "unexamined published application") have disclosed a method in which an adsorbing device is arranged in the exhaust gas path between the catalyst device and the internal combustion engine, so as to adsorb the formaldehyde, methanol, and other substances which are discharged until the catalyst becomes active. The formaldehyde and other substances thus adsorbed are released from the adsorbing device as the exhaust gas temperature increases. However, by that time, i.e., before the formaldehyde and other substances are released, the temperatures of the catalyst become sufficiently elevated that the catalyst acts to decompose the organic substances. Thus, during warming up and thereafter too, release of the highly contaminated exhaust gas into the air can be prevented.

However, in the exhaust gas purifying device with the adsorbing device set before the catalyst device, the exhaust gas temperature is decreased because of the thermal capacity and surface heat radiation of the adsorbing device, and therefore the exhaust gas temperature at the inlet of the catalyst device is increased later than in the case where no adsorbing device is used upstream of the exhaust gas purifying device. That is, the adsorbing device for holding the harmful gas until the exhaust gas becomes high enough to make the catalyst active operates to delay the rise in temperature of the catalyst, thereby to delay the start of activity of the catalyst device.

Accordingly, an object of this invention is to eliminate the above-described difficulty accompanying a conventional exhaust gas purifying device. More specifically, an object of the invention is to provide an exhaust gas purifying device in which the catalyst becomes active more quickly than in prior art devices.

SUMMARY OF THE INVENTION

The foregoing object of the invention has been achieved by the provision of an exhaust gas purifying device comprising: a catalyst device installed in the exhaust gas path of an internal combustion engine for treating the exhaust gas of the engine; an adsorbing device installed in the exhaust gas path between the catalyst device and the internal combustion engine, for treating the exhaust gas of the engine, which, according to a first aspect of the invention, comprises: a heat exchanger for performing heat transfer between the exhaust gas flowing from the internal combustion engine to the adsorbing device and the exhaust gas flowing from the adsorbing device to the catalyst device.

In a second embodiment of the invention the exhaust gas purifying device comprises: a catalyst device installed in the exhaust gas path of an internal combustion engine for treating the exhaust gas of the engine; an adsorbing device installed in the exhaust gas path between the catalyst device and the internal combustion engine, for treating the exhaust gas of the engine, in which, according to a second aspect of the invention, the catalyst device includes a catalyst secured in the low-temperature-side gas flow path of a heat exchanger, and the exhaust gas flowing from the internal combustion engine to the adsorbing device is allowed to flow to the high-temperature-side gas flow path of the heat exchanger.

The exhaust gas purifying device of the invention is so connected to the exhaust pipe of the internal combustion engine that the exhaust gas of the engine is passed in order through the high-temperature-side gas flow path of the heat exchanger, the adsorbing device, the low-temperature-side of the heat exchanger, the catalyst device and the muffler.

In the exhaust gas purifying device according to the second embodiment of the invention, the catalyst is provided in the low-temperature-side gas flow path of the heat exchanger, and therefore the exhaust gas is discharged into the air to the muffler immediately after passing through the low-temperature-side gas flow path of the heat exchanger.

In the case of the exhaust gas purifying device according to the first embodiment of the present invention, above, heat transfer is carried out between the high temperature exhaust gas which has already just come out of the internal combustion engine and the low temperature exhaust gas which has been subjected adsorption treatment. Hence, at the start of the engine the temperature of the exhaust gas at the inlet of the adsorbing device of the present invention is relatively low when compared with the prior art exhaust gas purifying device having no heat exchanger, and the harmful gases are adsorbed by the adsorbent with high efficiency in the present invention. Furthermore, the temperature of the exhaust gas to be treated with the catalyst is increased, so that the catalyst is increased in temperature quickly; that is, it becomes active quickly. The exhaust gas purifying device according to the second aspect of the invention is different from the one according to the first aspect in that the heat of the high temperature exhaust gas is transferred to the catalyst through the heat transmitting wall of the heat exchanger, to increase the temperature of the catalyst quickly.

DESCRIPTION OF THE PREFERRED EMBODIMENT

Preferred embodiments of this invention will be described with reference to the accompanying drawings.

Figure 1:
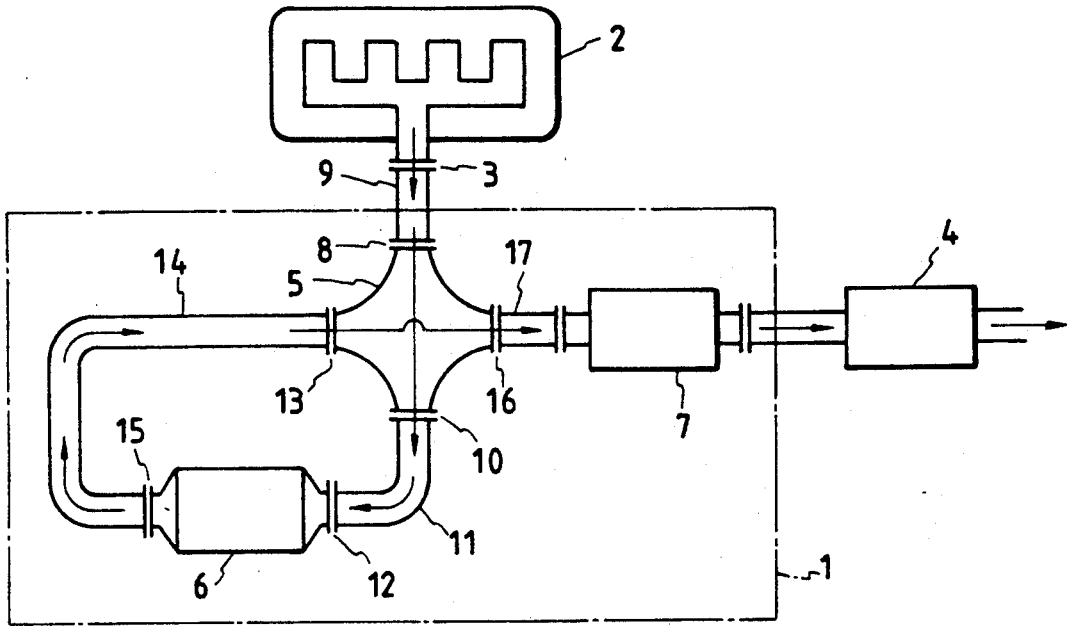
FIG. 1 is a block diagram showing the arrangement of a first embodiment of an exhaust gas purifying device according to the present invention.

FIG. 1 shows a first embodiment of an exhaust gas purifying device of the present invention in operation. The exhaust gas purifying device 1 is connected between the exhaust pipe 3 and the muffler 4 of a diesel engine 2, and it comprises: a heat exchanger 5; an adsorbing device 6; and a catalyst device 7. The heat exchanger 5 has a high-temperature-side gas flow path and a low-temperature-side gas flow path. The inlet 8 of the high-temperature-side gas flow is connected through a pipe 9 to the exhaust pipe 3, and the outlet 10 is connected through a pipe 11 to the inlet 12 of the adsorbing device 6. The inlet 13 of the low-temperature-side gas flow path is connected through a pipe 14 to the outlet 15 of the adsorbing device 6, and the outlet 16 thereof is connected through a pipe 17 to the catalyst device 7.

As is apparent from the above-description, the exhaust gas of the engine 2 is discharged into the air after flowing through the high-temperature-side gas flow path of the heat exchanger 5, the adsorbing device 6, the low-temperature-side gas flow path of the heat exchanger 5, the catalyst device 7 and the muffler 4 in the stated order.

In this operation, the heat of the high temperature exhaust gas which has just come out of the exhaust pipe 3 is transmitted to the exhaust gas which has been decreased in temperature by passing through the adsorbing device 6, as a result of which the exhaust gas increased in temperature flows into the catalyst device 7, where it contacts the catalyst. Accordingly, at the start of the engine, the temperature of the catalyst is increased more quickly than in the case where the heat exchanger 5 is not employed; that is, the catalyst is made active more quickly. On the other hand, the exhaust gas which has been lowered in temperature passing through the heat exchanger 5 goes into the adsorbing device 6, the temperature rise of the adsorbent is delayed with the result that the temperature conditions suitable for adsorption are maintained for a longer time than they otherwise would be without the present invention.

Figure 2:
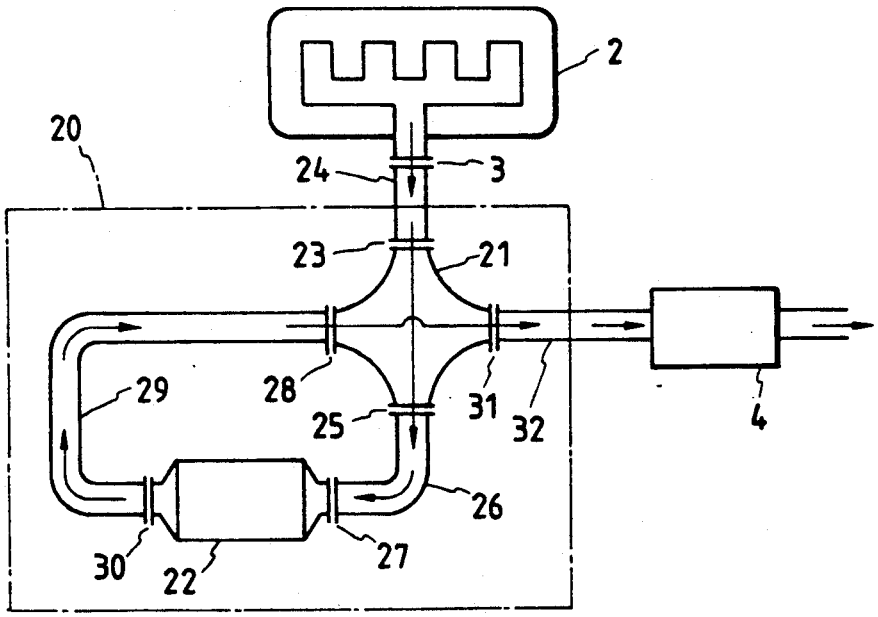
FIG. 2 is a block diagram showing the arrangement of a second embodiment of an exhaust gas purifying device according to the present invention.

FIG. 2 shows a second embodiment of an exhaust gas purifying device according to the invention in operation. As is the case with the above-described first embodiment, the exhaust gas purifying device 20 is connected between the exhaust pipe 3 and the muffler 4 of a diesel engine, and it comprises: a heat exchanger 21 which also functions as a catalyst device, and an adsorbing device 22. The heat exchanger 21 has a low-temperature-side gas flow path, and a high-temperature-side gas flow path. The catalyst is secured to or in the low-temperature-side gas flow path of the heat exchanger 21. The inlet 23 of the high-temperature-side gas flow path is connected through a pipe 24 to the exhaust pipe 3, and the outlet 25 is connected through a pipe 26 to the inlet 27 of the adsorbing device 22. The inlet 28 of the low-temperature-side gas flow path is connected through a pipe 29 to the outlet 30 of the adsorbing device 22, and the outlet 31 is connected through a pipe 32 to the muffler 4.

As is apparent from the above description, the exhaust gas of the engine 2 is discharged into the air after passing through the high-temperature-side gas flow path of the heat exchanger 21, the adsorbing device 22, the low-temperature-side gas flow path of the heat exchanger 21, and the muffler 4 in the stated order.

The heat of the high temperature exhaust gas which has just come out of the exhaust pipe 3 is transmitted through the heat transmitting wall, or other means, of the heat exchanger 21 to the catalyst in the low-temperature-side gas flow path, thus increasing the temperature of the catalyst quickly. On the other hand, the exhaust gas which has been decreased in temperature passing through the heat exchanger 21 flows into the adsorbing device 22, so that the temperature rise of the adsorbent is delayed with the result temperature conditions are suitable for adsorption are maintained for a longer time than would be achieved without application of the present invention.

As was described above, in the exhaust gas purifying device of the present invention, the exhaust gas of the internal combustion engine flows through the high-temperature-side gas flow path of the heat exchanger into the adsorbing device. It then flows through the low-temperature-side gas flow path of the heat exchanger so as to be subjected to catalyst treatment. Accordingly, heat transfer is carried out between the high temperature exhaust gas which is going into the adsorbing device and the low temperature exhaust gas which has been subjected to adsorption, or the catalyst. Hence, when compared with a conventional exhaust gas purifying device having no heat exchanger, at the start of the engine: the temperature of the exhaust gas in the device of the present invention is relatively low at the inlet of the adsorbing device; the efficiency of adsorption of harmful gases is high; and the temperature, and consequent activity of the catalyst is increased quickly.

Thus, with the exhaust gas purifying device of the present invention, at the start of the engine the exhaust gas is positively purified, and the adsorbing device can have a smaller adsorption capacity than is possible in the case of a conventional exhaust gas purifying device. This permits designs decreasing the thermal capacity of (and heat loss to) the adsorbing device and a quick start of the catalyst device.

The exhaust gas purifying device of the present invention is not limited as to type of adsorbent and/or catalyst. They can be selected according to the type of the internal combustion engine and the kind of fuel employed.

Although the invention has been described with pipes conveying the exhaust gas from device to device in the purifying device, it will be understood that a variety of means, known in the art, may be employed to convey the gas and place the various devices in operative communication one to another.

Having described the invention, it will be apparent to those skilled in the art that various modifications may be made thereto without departing from the spirit and scope of this invention as defined in the appended claims.

What is claimed is:

1. An exhaust gas purifying device comprising:

a catalyst device disposed in an exhaust gas path of an internal combustion engine for treating the exhaust gas of the engine;

an adsorbing device disposed in the exhaust gas path between said catalyst device and the engine;

means for heat exchange disposed in said exhaust gas path to accomplish heat transfer between the exhaust gas flowing from the internal combustion engine to said adsorbing device and the exhaust gas flowing from said adsorbing device to said catalyst device.

2. The exhaust gas purifying device of claim 1, wherein said means for heat exchange is disposed in said exhaust gas path and the exhaust gas passes through passages in said means for heat exchange.

3. An exhaust gas purifying device comprising:

a catalyst device disposed in an exhaust gas path of an internal combustion engine for treating the exhaust gas of the engine;

an adsorbing device disposed in the exhaust gas path between said catalyst device and the internal combustion engine, for treating the exhaust gas of the engine;

means for heat exchange having a low-temperature-side gas flow path and a high-temperature-side gas flow path, disposed in said exhaust gas path;

wherein said catalyst device includes a catalyst disposed in the low-temperature-side gas flow path of said means for heat exchange; and the exhaust gas flowing from the internal combustion engine to said adsorbing device is allowed to flow to the high-temperature-side gas flow path of means for heat exchange prior to its passing through the adsorbing device.

4. A process for purifying an exhaust gas from an engine comprising:

passing the gas through a high temperature side of means for heat exchange;

then passing the gas through an adsorbing device;

then passing the gas through a low temperature side of the means for heat exchange; and then passing the gas to a catalyst device.

5. The process of claim 4, wherein:

said adsorbing device is constructed and arranged to adsorb components from said exhaust gas at initially low exhaust gas temperatures and to desorb previously desorbed components at increased operating exhaust gas temperatures.

6. The process of claim 4, wherein:

warm-up of the engine said means for heat exchange is constructed and arranged to decrease the temperature of the gas passing to the adsorbing device and to raise the temperature of the gas leaving the adsorbing device and passing to the catalyst device, thus enhancing the adsorption effect in the adsorption device while quickening the heat-up of the catalyst device to effective operating temperatures of the catalyst.

7. A process for purifying an exhaust gas of an engine comprising:

passing the exhaust gas through a high temperature side of a means for heat exchange;

then passing the gas through an adsorbing device;

then passing the exhaust gas through a low temperature side of the means for heat exchange wherein is disposed a catalyst device.

8. The process of claim 7, wherein:

said adsorbing device is constructed and arranged to adsorb components from said exhaust gas at initially low exhaust gas temperatures and to desorb previously desorbed components at increased operating exhaust gas temperatures.

9. The process of claim 7, wherein during warm-up of the engine said means for heat exchange is constructed and arranged to remove heat from the gas passing through the high temperature side of the means for heat exchange thus reducing the temperature of the gas passing to the adsorbing device and tends to communicate at least a portion of said removed heat to said catalyst disposed in said low temperature side of said means for heat exchange thus enhancing the activity of the catalyst device.

* * * * *